United States Patent [19]

O'Brien

[11] 4,437,282

[45] Mar. 20, 1984

[54] INSULATION SUPPORT HANGER

[76] Inventor: Michael B. O'Brien, 23 Shelburne Rd., Yonkers, N.Y. 10710

[21] Appl. No.: 386,190

[22] Filed: Jun. 7, 1982

[51] Int. Cl.[3] ..... E04B 2/00

[52] U.S. Cl. ..... 52/407; 52/712; 248/217.2; 248/302

[58] Field of Search ..... 52/404, 406, 407, 712; 214/10; 248/57, 217.2, 302

[56] References Cited

U.S. PATENT DOCUMENTS

| | | | |
|---|---|---|---|
| 1,846,272 | 3/1932 | Powell | 52/407 |
| 2,007,374 | 7/1935 | Kaehne | 52/407 |
| 2,189,963 | 2/1940 | Schoneberger | 52/712 |
| 2,236,394 | 4/1941 | MacKechnie | 52/407 |
| 2,565,206 | 8/1951 | Day | 52/407 |
| 2,898,741 | 8/1959 | Milliken | 52/712 |
| 2,994,114 | 8/1961 | Black | 52/317 |
| 3,145,505 | 8/1964 | Cornelius | 52/712 |
| 4,023,323 | 5/1977 | Fortin | 52/404 |

*Primary Examiner*—Henry E. Raduazo

*Attorney, Agent, or Firm*—Mark T. Basseches; Paula T. Basseches

[57] ABSTRACT

The present invention relates to a support hanger for maintaining insulating material, which is supplied in roll form, in the spaces between joists and particularly floor joists. The device comprises a mounting member adapted to span the space between adjacent joists and transversely extending retainer members for supporting the insulation material in a desired position.

2 Claims, 2 Drawing Figures

FIG. 1
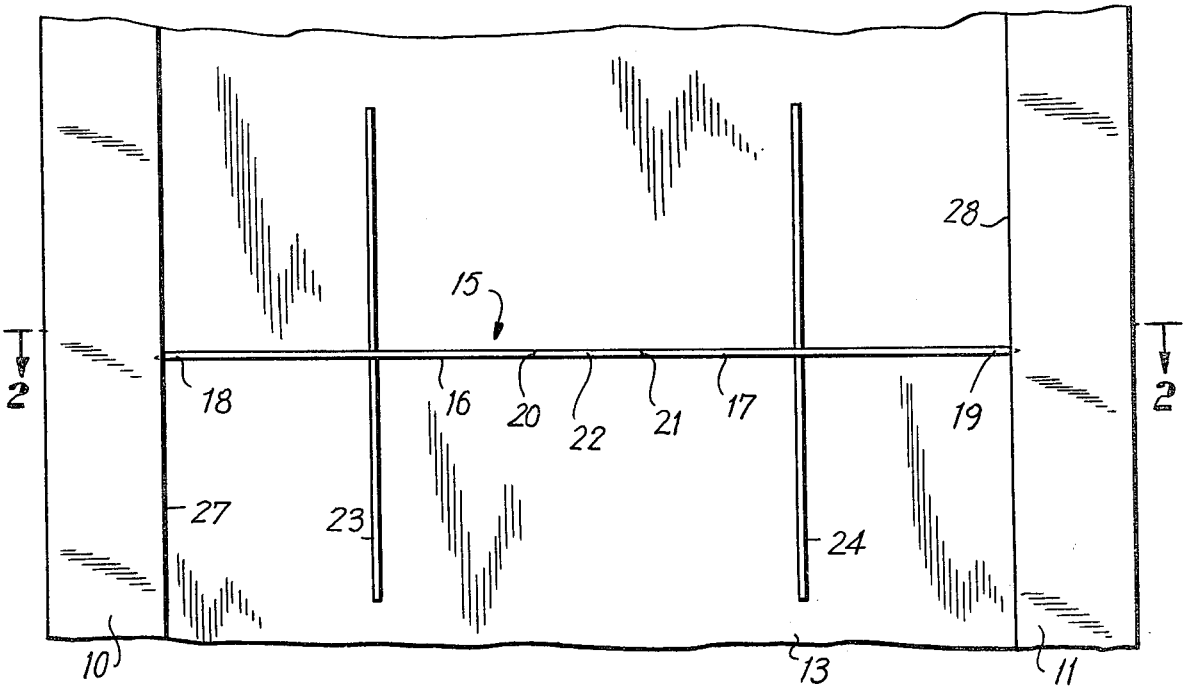
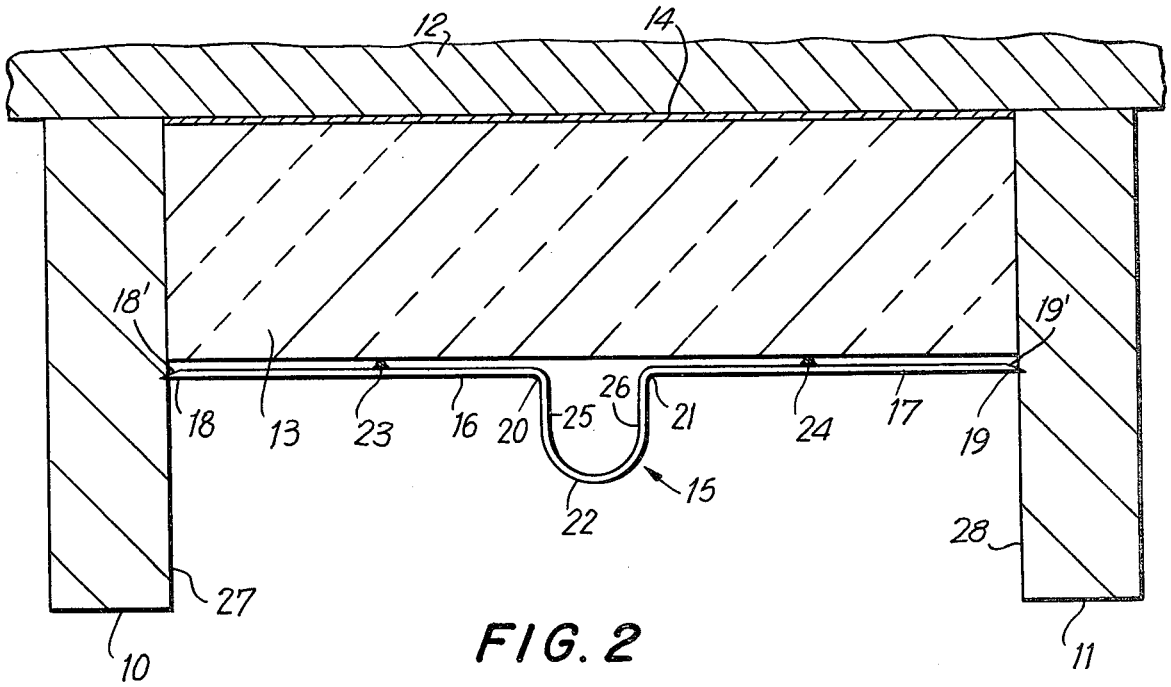
FIG. 2

INSULATION SUPPORT HANGER

BACKGROUND OF THE INVENTION

1. Field of the Invention

The present invention is in the construction field and pertains more particularly to a hanger or installation aid which may be employed to support insulation between joists, studs, etc. of a dwelling or like structure.

2. The Prior Art

The expense of heating fuels and like energy resources has resulted in increased reliance on insulating materials to reduce heat transfer in dwellings and like applications. Such heat transfer is wasteful of energy by permitting heat loss in winter and by enabling the ingress of heat into air conditioned spaces in summer.

A typical form of insulation most readily available for both initial construction and for the do-it-yourself householder is comprised of elongate rolls of fiberglass or like insulating materials. Typically there is appended to the fiberglass a backing foil of reflective aluminum or like material.

In the usual dwelling, the joists, rafters, etc., in accordance with standard practice, are spaced 16" on center. Accordingly, insulating materials intended for use in such structures are comprised of a band of insulating material of 16" width or slightly less, bonded to an aluminum foil backing or composite foil-plastic backing, the width of the backing, at least at tab-defining spaced intervals, being greater than the width of the insulation.

The described insulating material is applied by laying the material between the studs, joists, etc., with the reflective aluminum foil nearest the interior of the dwelling, and stapling the extending tabs to the innermost surfaces of the joists or studs. It is desirable that the reflective aluminum be nearest the interior surface to minimize radiation heat loss.

While this manner of installation is practicable for virtually all new constructions since there is ready access to both the interior and the exterior of the studs and joists, the application of insulation to already constructed dwellings presents particular problems. By way of example, if a home owner were to seek to apply rolls of insulation under the floor boards and the foil layer were positioned closest to the under surface of the floor, the tabs or anchor points of the backing would be consealed. It is therefore not uncommon in such floor insulating situations for the installer to place the insulation batt nearest the under surface of the floor for ease of insulation, thus compromising the radiation loss characteristics of the installation.

Moreover, the task of simultaneously supporting the insulation in a desired position beneath the floor boards and stapling is awkward, often requiring the use of an assistant.

SUMMARY OF THE INVENTION

The present invention relates to an inexpensive yet effective insulation support hanger characterized in that it permits insulating materials of the type described to be rapidly and effectively emplaced in the desired manner, i.e. with the foil adjacent the surface to be insulated.

The hanger is comprised of a pair of elongate rods centrally connected by an expansible portion, the rods including sharpened barbs at their distal ends. The rods may be integrally formed from a single piece of rod stock and the expansible portion may comprise a loop, partial loop or bight. One or more retainer members project laterally relative to the rods and assure that the foil is pressed uniformly against the boundary. The spacing of the distal ends of the rods in the free or untensioned position thereof is greater than the separation of the opposed faces of the joists.

The device is used by placing the insulation in the desired position, compressing the loop or bight to draw the distal ends closer together, pressing the hanger into position between the joists and thereafter releasing the expansible loop or bight, whereupon the sharpened ends of the rods impress themselves into the joists, whereby the hanger and, hence, the insulation is retained in position.

It is accordingly an object of the invention to provide an insulation support hanger to enable the facile mounting of elongate bands of insulation between adjacent spaced studs, joists or the like.

To attain such objects and such further objects as may appear herein or be hereinafter pointed out, reference is made to the accompanying drawings, forming a part hereof, in which:

FIG. 1 is a fragmentary bottom plan view of an area to be insulated, illustratively the space between the floor boards of an existing dwelling with a length of insulation supported by a hanger in accordance with the invention;

FIG. 2 is a vertical section taken on the line 2—2 of FIG. 1.

Referring to the drawings, there is shown in the figures, by way of example, an under floor insulating arrangement utilizing a hanger in accordance with the invention. More particularly, a pair of floor joists 10, 11, to which a floor surface 12 is mounted, is intended to be insulated by an elongate roll of insulating material comprising a fibrous mass 13 having bonded thereto a flexible foil 14.

Illustratively, the fibrous mass 13 may comprise a batt of fibrous material and the foil 14 may comprise reflective aluminum foil or a composite of reflective foil and plastic, As noted hereinabove, the effectiveness of the insulation is enhanced if the reflective foil 14 is nearest the under surface of the floor 12. However, it will be readily recognized that since the typical method of installing involves stapling projecting portions (not shown) of the foil 14 which extend laterally beyond the borders of the insulation layer 13 to the joists 10, 11, if the foil is placed nearest the under surface of the floor 12, as shown, the tabs would be inaccessible to the stapler since they project a lesser distance than the thickness of the insulation.

In accordance with the invention, the insulation is supported independently of any connection with tabs through the use of a hanger device 15 as shown.

The hanger device 15 may include a mounting member comprised of rod portions 16, 17, the distal ends 18, 19, respectively, of which are sharpened and the juxtaposed ends 20, 21 of which are connected to a bight or expansion loop 22. Preferably the rods 16, 17 and the loop 22 may be integrally formed from a single length of spring steel material. The sharpened end portions 18, 19 are preferably beveled, the inclination of the bevels 18', 19' being such as to converge in the direction opposite the loop 22.

Preferably two or more transversely extending insulation retainer members 23, 24 may be secured to the rods 16, 17, respectively, so as to provide supports extending lengthwisely of the roll of insulation.

The device is used by emplacing the insulation in the position noted and squeezing the opposed legs 25, 26 of the bight portion 22 toward each other, whereupon the spacing of distal ends 18, 19 is reduced, providing clearance to enable positioning of the hanger between the opposing faces 27, 28 of the joists 10, 11, respectively.

After the hanger is positioned as shown, releasing the legs 25, 26 will cause the rods 16, 17 to spring outwardly, whereupon the sharpened or beveled faces 18, 19 will indent into the wood of the joists, securely retaining the hanger and, hence, the insulation in position.

As will be apparent, the operation of the hanger may be readily effected by the installer, using only one hand, the installer merely holding the insulation in appropriate position, advancing the hanger to the desired space, and releasing the bight portion. By sequentially repeating the described operation, an extended length of insulating material may be rapidly and effectively installed.

As will be evident to those skilled in the art and familiarized with the instant disclosure, numerous variations in details of construction may be made without departing from the spirit of the invention. By way of example, the specific form of expansion member may be varied from the simple U-shaped bight illustrated. Additionally, it is feasible for the transversely extending members 23, 24 to be formed integrally with the rods 16, 17 and the bight 22, whereby the entire hanger is formed from a single piece of metal.

Accordingly, the invention is to be broadly construed within the scope of the appended claims.

Having thus described the invention and illustrated its use, what is claimed as new and is desired to be secured by Letters Patent is:

1. An insulation hanger device adapted to be applied by one-handed operation of an installer into mounted position between opposed parallel wooden surfaces, such as the surfaces of adjacent studs or joists, comprising an integral length of resilient metallic bar stock material, said material being bent to define a central bight or loop portion defining an expansion member generally U-shaped in plan and including spaced, generally parallel legs, the spacing between said legs being such as to permit the same to be squeezed toward each other by the hand of an installer, a linear rod member extending outwardly from the end of each said leg, said rod members being in co-axial alignment, the distal ends of said rod members defining sharpened points, the combination including retainer portions defined by metallic members affixed to said rod members in the area between said legs and points, said retainer portion metallic members being disposed perpendicular to the plane of said bight, the spacing of said distal end portions being variably responsive to compression and release to an expanded condition of said central expansion member.

2. Apparatus in accordance with claim 1 wherein said points are beveled, the sharpened edges of said bevels being disposed on the side of said rods from which said bight projects.

* * * * *